US012753458B2

(12) United States Patent
Lee et al.

(10) Patent No.: US 12,753,458 B2
(45) Date of Patent: Oct. 6, 2026

(54) STEEL SHEET WITH EXCELLENT PHOSPHATABILITY AND MANUFACTURING METHOD THEREFOR

(71) Applicant: POSCO Co., Ltd, Pohang-si (KR)

(72) Inventors: Byoungho Lee, Pohang-si (KR); Jina Kim, Pohang-si (KR); Youngkwang Hong, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 515 days.

(21) Appl. No.: 18/268,571

(22) PCT Filed: Dec. 17, 2021

(86) PCT No.: PCT/KR2021/019331
§ 371 (c)(1),
(2) Date: Jun. 20, 2023

(87) PCT Pub. No.: WO2022/139355
PCT Pub. Date: Jun. 30, 2022

(65) Prior Publication Data

US 2024/0043955 A1 Feb. 8, 2024

(30) Foreign Application Priority Data

Dec. 21, 2020 (KR) ..... 10-2020-0179598

(51) Int. Cl.
*C21D 9/46* (2006.01)
*C21D 8/0221* (2026.01)
(Continued)

(52) U.S. Cl.
CPC ..... *C21D 9/46* (2013.01); *C21D 8/0226* (2013.01); *C21D 8/0236* (2013.01);
(Continued)

(58) Field of Classification Search
CPC ..... C21D 9/46; C21D 8/0226; C21D 8/0236; C21D 8/0273; C21D 2211/003;
(Continued)

(56) References Cited

U.S. PATENT DOCUMENTS

2019/0194774 A1 6/2019 Zhou et al.

FOREIGN PATENT DOCUMENTS

CN 103290308 A 9/2013
CN 106011652 A 10/2016
(Continued)

OTHER PUBLICATIONS

Office Action dated Oct. 8, 2024, issued in corresponding Japanese Patent Application No. 2023-538162.
Office Action and Search Report dated Sep. 24, 2025 issued in the corresponding Chinese Patent Application No. 202180093866.X.
International Search Report and Written Opinion issued in corresponding International Application No. PCT/KR2021/019331 issued Apr. 27, 2022, with English translation.
Chinese Notice of Allowance dated Jul. 13, 2026 issued in Chinese Patent Application No. 202180093866.X.

*Primary Examiner* — Adil A. Siddiqui
(74) *Attorney, Agent, or Firm* — Morgan Lewis & Bockius LLP

(57) ABSTRACT

A steel sheet with excellent phosphatability, according to one embodiment of the present invention, comprises, by wt %, 0.02-0.06% of carbon (C), 0.01% or less of silicon (Si) (excluding 0%), 0.1-0.24% of manganese (Mn), 0.02% or less of aluminum (Al) (excluding 0%), 0.015-0.04% of phosphorus (P), and the balance of iron (Fe) and inevitable impurities, and has an oxide layer having a thickness of 10 nm or less inward from the surface of the steel sheet, and satisfies the following formula 1.

$$([Mn]+[Si]+[Al])/(3\times[P])\leq 0.6 \quad \text{[Formula 1]}$$

(In formula 1, [Mn], [Si], [Al] and [P] mean the maximum amount of each element when elemental analysis is carried out in the thickness direction of the oxide layer.)

11 Claims, 3 Drawing Sheets

(51) Int. Cl.

| | |
|---|---|
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23C 22/03*** | (2006.01) |
| ***C23G 1/08*** | (2006.01) |

(52) U.S. Cl.
CPC ..... *C21D 8/0273* (2013.01); *C22C 38/002* (2013.01); *C22C 38/02* (2013.01); *C22C 38/04* (2013.01); *C22C 38/06* (2013.01); *C23C 22/03* (2013.01); *C23G 1/081* (2013.01); *C21D 2211/003* (2013.01); *C21D 2211/005* (2013.01)

(58) Field of Classification Search
CPC .... C21D 2211/005; C21D 6/008; C21D 8/02; C21D 8/0284; C22C 38/002; C22C 38/02; C22C 38/04; C22C 38/06; C22C 38/00; C22C 38/001; C23C 22/03; C23G 1/081
See application file for complete search history.

(56) References Cited

FOREIGN PATENT DOCUMENTS

| | | | | | |
|---|---|---|---|---|---|
| CN | 106244923 | A | | 12/2016 | |
| CN | 107419185 | A | | 12/2017 | |
| JP | H02-101200 | A | | 4/1990 | |
| JP | H04-247850 | A | | 9/1992 | |
| JP | 2810245 | B2 | * | 10/1998 | ..... C25D 3/56 |
| JP | H11-302782 | A | | 11/1999 | |
| JP | 2000-273575 | A | | 10/2000 | |
| JP | 2001-303179 | A | | 10/2001 | |
| JP | 2004-018970 | A | | 1/2004 | |
| JP | 2006-265682 | A | | 10/2006 | |
| JP | 2014-118584 | A | | 6/2014 | |
| JP | 2016-113648 | A | | 6/2016 | |
| JP | 2017-145471 | A | | 8/2017 | |
| KR | 10-1992-0014947 | A | | 8/1992 | |
| KR | 10-2019-0034595 | A | | 4/2019 | |
| KR | 10-2020-0055874 | A | | 5/2020 | |
| KR | 10-2020-0076478 | A | | 6/2020 | |
| WO | 2020/095682 | A1 | | 5/2020 | |

* cited by examiner

STEEL SHEET WITH EXCELLENT PHOSPHATABILITY AND MANUFACTURING METHOD THEREFOR

CROSS-REFERENCE OF RELATED APPLICATIONS

This application is the U.S. National Phase under 35 U.S.C. § 371 of International Patent Application No. PCT/KR2021/019331, filed on Dec. 17, 2021, which in turn claims the benefit of Korean Application No. 10-2020-0179598, filed on Dec. 21, 2020, the disclosures of which applications are incorporated by reference herein.

TECHNICAL FIELD

An embodiment of the present invention relates to a steel sheet with excellent phospatability and a manufacturing method of the same. More particularly, an embodiment of the present invention relates to a steel sheet having excellent corrosion resistance and phosphate treatment surface characteristics and a manufacturing method of the same characterized in that, in performing phosphate treatment to impart corrosion resistance to a surface of the steel sheet used as a raw material for drum materials, a size of phosphate crystals generated on the surface after the phosphate treatment is fine and the phosphate crystals are evenly distributed over the entire surface of the steel sheet.

BACKGROUND ART

Phosphate treatment is performed on surfaces of steel materials for the purpose of securing rust prevention, improving long-term corrosion resistance, and improving adhesion before painting during painting.

The phosphate treatment means treatment that an electrochemical potential difference is generated during a contact process between a phosphate solution and a steel sheet to generate electrons while the steel sheet is dissolved and Fe is ionized, so, when pH increases, a stable metal phosphate crystal is generated on a surface of the steel plate and formed on the surface by a growing method. The phosphate treatment is a process to impart paintability and corrosion resistance to original plates such as automobile steel sheets, drum steel sheets, and electrical steel sheets.

A solution usually used for phosphate treatment is zinc phosphate, and has a crystal structure of two phases, phosphophyllite and hopeite, respectively, or a crystal structure in which two phases are mixed after the phosphate treatment depending on the crystal shape of the phosphate formed on the surface of the steel plate. The phosphophyllite is a dense spherical crystal, and is generated when Fe ions exist in phosphate crystals and react together, and the hopeite has a granular, narrow and wide structure. Both of these phases take the form of densely covering a steel material. In this case, the phosphophyllite (P) has excellent corrosion resistance to acid or alkali compared to Hopeite (H), and the result of phosphate treatment with a relatively high fraction of P has better corrosion resistance. For this reason, when the iron eluted from the steel sheet follows the deposition treatment which is a condition in which the film is easily contained, the ratio of P on the surface increases, but in the case of spray treatment, it differs depending on the treatment liquid, but has a relatively high fraction of H.

Whether the phosphate treatability is good or bad is eventually determined by how densely the phosphate crystals cover the surface of the steel sheet after the phosphate treatment process, which relies on the size and coverage of the phosphate crystals.

Factors that inhibit the acid reactivity of the steel sheet generally include the type and thickness of oxide covering the surface of the steel sheet. In particular, when the oxide is formed thickly, an elution rate of Fe for the growth of a phosphate nucleus, which is the nucleus of the phosphate, slows down, so the density of the phosphate nucleus decreases and the phosphoric acid crystals are coarsened and has low coverage by the sparsely formed phosphoric acid nucleus.

Due to recent environmental regulations, a concentration of a phosphating solution has become increasingly dilute, resulting in the problem that the phosphate treatment does not occur smoothly. In order for the phosphate to be applied well to the surface of the steel sheet, the phosphate nucleus should be formed at a high density while the steel sheet reacts with phosphoric acid at high speed. However, the decrease in the concentration of the phosphoric acid treatment solution due to wastewater treatment problems does not facilitate the initial acid reaction to inhibit the formation of the phosphoric acid nucleus, resulting in the problem that the phosphate crystals are coarsened but do not cover the entire surface of the steel material. That is, when sufficient reactivity is not secured even at a low phosphoric acid concentration, the problem that adversely affects phosphate treatability continuously occurs.

DISCLOSURE

Technical Problem

The present invention attempts to provide a steel sheet with excellent phospatability and a manufacturing method of the same. More particularly, the present invention provides a steel sheet having excellent corrosion resistance and phosphate treatment surface characteristics and a manufacturing method of the same characterized in that, in performing phosphate treatment to impart corrosion resistance to a surface of the steel sheet used as a raw material for drum materials, a size of phosphate crystals generated on the surface after the phosphate treatment is fine and the phosphate crystals are evenly distributed over the entire surface of the steel sheet.

Technical Solution

According to an embodiment of the present invention, a steel sheet with excellent phosphatability includes, by wt %, 0.02 to 0.06% of carbon (C), 0.01% or less of silicon (Si) (excluding 0%), 0.1 to 0.24% of manganese (Mn), 0.02% or less of aluminum (Al) (excluding 0%), 0.015 to 0.04% of phosphorus (P), and the balance of iron (Fe) and inevitable impurities.

The steel sheet with excellent phosphatability has an oxide layer having a thickness of 10 nm or less inward from the surface of the steel sheet and satisfies the following formula 1.

$$([Mn]+[Si]+[Al])/(3\times[P])\leq 0.60 \quad \text{[Formula 1]}$$

(In formula 1, [Mn], [Si], [Al] and [P] mean the maximum amount of each element when elemental analysis is carried out in the thickness direction of the oxide layer.)

The steel sheet with excellent phosphatability may contain cementite in an area fraction of 2% or more, and the balance of ferrite.

A pickle lag time may be 20 seconds or less when the steel sheet is immersed in 5% of sulfuric acid aqueous solution at 30° C.

When the steel sheet is immersed in 5% of sulfuric acid aqueous solution at 30° C., a corrosion reduction ratio is 0.55 mg/cm$^2$/hr or more.

A yield strength may be 220 to 270 MPa.

An average length of major axes of phosphate particles formed after phosphate treatment may be 10 μm or less.

Phosphate particles formed after the phosphate treatment may occupy 90 area % or more of the surface of the steel sheet.

According to another exemplary embodiment of the present invention, a method of manufacturing a steel sheet with excellent phospatability includes manufacturing a hot-rolled steel sheet by hot-rolling a slab containing, by wt %, to 0.06% of carbon (C), 0.01% or less of silicon (Si) (excluding 0%), 0.1 to 0.24% of manganese (Mn), 0.02% or less of aluminum (Al) (excluding 0%), 0.015 to 0.04% of phosphorus (P), and the balance of iron (Fe) and inevitable impurities; manufacturing a cold-rolled steel sheet by cold-rolling the hot-rolled steel sheet; annealing the cold-rolled steel sheet; and temper-rolling the annealed cold-rolled steel sheet.

In the manufacturing of the hot-rolled steel sheet, a coiling temperature may be 650 to 750° C. and in the annealing step, a soaking temperature may be 700 to 780° C.

In the manufacturing of the hot-rolled steel sheet, the final hot rolling temperature (FDT) may be 800 to 950° C.

In the manufacturing of the cold-rolled steel sheet by the cold-rolling, the reduction ratio may be 70 to 85%.

After the step of annealing the cold-rolled steel sheet, before the temperrolling of the annealed cold-rolled steel sheet, the cooling may be performed to a final cooling temperature of 80 to 150° C.

In the annealing step, the annealing may be performed in an atmosphere containing 5% by volume or more of hydrogen and the rest of nitrogen and at a dew point of −30° C. or lower.

Advantageous Effects

According to an embodiment of the present invention, a steel sheet with excellent phospatability can be effectively used as a raw material for a steel sheet subjected to phosphate treatment to impart paintability and rust prevention to the steel sheet.

According to another embodiment of the present invention, a steel sheet with excellent phospatability can easily secure phosphate treatability even at a low phosphoric acid concentration, and can be used not only for containers but also for automobiles and home appliances.

MODE FOR INVENTION

Figure 1:
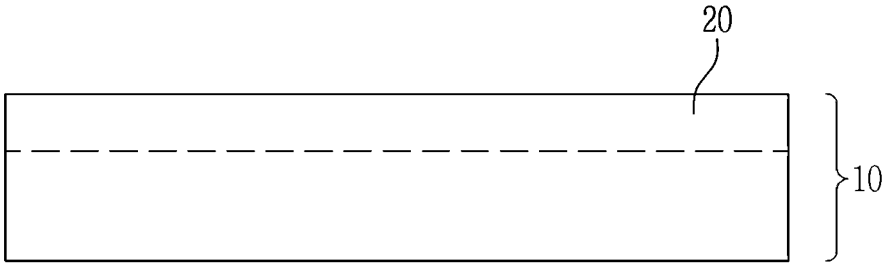
FIG. 1 is a schematic cross-sectional view of a steel sheet according to an embodiment of the present invention.

The terms first, second, third, and the like are used to describe, but are not limited to, various parts, components, areas, layers and/or sections. These terms are used only to distinguish a part, component, region, layer, or section from other parts, components, regions, layers, or sections. Accordingly, a first part, a component, an area, a layer, or a section described below may be referred to as a second part, a component, a region, a layer, or a section without departing from the scope of the present disclosure.

Terminologies used herein are to mention only a specific exemplary embodiment, and do not to limit the present invention. Singular forms used herein include plural forms as long as phrases do not clearly indicate an opposite meaning. The meaning including used in the present specification concretely indicates specific properties, areas, integer numbers, steps, operations, elements, and/or components, and is not to exclude presence or addition of other specific properties, areas, integer numbers, steps, operations, elements, and/or components thereof.

In addition, unless otherwise specified, % means wt %, and 1 ppm is wt %.

In an embodiment, further including additional elements means that the balance of iron (Fe) is replaced and included as much as the additional amount of the additional elements.

All terms including technical terms and scientific terms used herein have the same meaning as the meaning generally understood by those skilled in the art to which the present invention pertains unless defined otherwise. Terms defined in commonly used dictionaries are additionally interpreted as having meanings consistent with related technical literature and currently disclosed content, and are not interpreted in ideal or very formal meanings unless defined.

Hereinafter, an embodiment will be described in detail so that a person of ordinary skill in the art to which the present invention pertains can easily implement the present invention. As those skilled in the art would realize, the described embodiments may be modified in various different ways, all without departing from the spirit or scope of the present invention.

According to an embodiment of the present invention, a steel sheet with excellent phosphatability includes, by wt %, 0.02 to 0.06% of carbon (C), 0.01% or less of silicon (Si) (excluding 0%), 0.1 to 0.24% of manganese (Mn), 0.02% or less of aluminum (Al) (excluding 0%), 0.015 to 0.04% of phosphorus (P), and the balance of iron (Fe) and inevitable impurities.

In this case, first, the components of the steel sheet will be described in detail. As described below, Al, Mn, Si, and P in the steel sheet are concentrated in the oxide layer and have a concentration gradient inward from the surface. In an embodiment of the present invention, an element content in the steel sheet means an average content of the steel sheet in a thickness direction.

Carbon (C): 0.02 to 0.06 wt %

A carbon content of a steel sheet according to the present invention may be 0.02 to 0.06 wt %. When the carbon content in the steel is too low, the formation of secondary phases does not occur, so the expected local corrosion phenomenon does not occur, and when the carbon content is too high, a phenomenon that exceeds the desired strength may occur due to excessive carbide formation. Therefore, in an embodiment of the present invention, the carbon content is limited to 0.02 to 0.06 wt %. More specifically, C may be contained in an amount of 0.002 to 0.055 wt %.

Silicon (Si): 0.01 wt % or Less

A silicon content of a steel sheet according to the present invention may be 0.01 wt % or less. When the silicon content in the steel is too high, $SiO_2$ may be formed on the surface, and a composite phase of $SiO_2$ and Fe oxide may also be formed, resulting in a large amount of red scale. The red scale may cause defects that are not eliminated during cold-rolling pickling, and may form Si oxide itself during coldrolling annealing and may decrease acid reactivity. Therefore, in an embodiment of the present invention, a maximum amount of Si is limited to 0.01 wt % or less. More specifically, Si may be contained in an amount of 0.001 to 0.01 wt %. More specifically, Si may be contained in an amount of 0.003 to wt %.

Manganese (Mn): 0.10 to 0.24 wt %

Mn is a typical element that forms an oxide on a surface during annealing heat treatment of a cold-rolled steel sheet. In an embodiment of the present invention, the Si content, which may inhibit acid reactivity by forming surface oxides in a annealing heat treatment process, is limited to 0.01 wt % or less, and since the Si oxide itself is an environment in which a large amount of Si oxide may be formed, the Mn content is controlled to 0.24 wt % or less, so Mn oxide was actively inhibited. However, Mn is a typical solid-solution strengthening element, and when the Mn content is too low, it may cause a decrease in strength. Accordingly, Mn may be contained in an amount of 0.10 to 0.24 wt %. More specifically, Mn may be contained in an amount of 0.11 to 0.24 wt %.

Aluminum (Al): 0.020 wt % or Less

Al is an element used as a representative deoxidizer. However, in an embodiment of the present invention, Al also forms Al oxide on the surface of the steel material, and when the Al oxide is formed, acid reactivity may be inhibited. Therefore, Al may be contained in an amount of 0.020 wt % or less. More specifically, Al may be contained in an amount of 0.001 to 0.020 wt %. More specifically, Al may be contained in an amount of 0.010 to 0.019 wt %.

Phosphorous (P): 0.015 to 0.040 wt %

In an embodiment of the present invention, P acts to cause an elution reaction of Fe when the steel is exposed to an acidic environment. Therefore, the P content may be limited to 0.015 wt % or more. However, since P is a representative element that causes brittleness at room temperature and may make formability vulnerable when $Fe_3P$ precipitates at grain boundaries, an upper limit of P may be limited to 0.040 wt %. Accordingly, P may be contained in an amount of 0.015 to 0.040 wt %. More specifically, P may be contained in an amount of 0.016 to 0.038 wt %.

In addition to the above element components, the present invention includes Fe and inevitable impurities. Since the inevitable impurities are widely known in the art, a detailed description thereof will be omitted. In an embodiment of the present invention, the addition of an effective component other than the above components is not excluded, and when an additional component is further included, it is contained in place of the balance of Fe.

FIG. 1 is a schematic diagram of a cross section of a steel sheet in a thickness direction according to an embodiment of the present invention. As illustrated in FIG. 1, in a steel sheet 10 according to an embodiment of the present invention, an oxide layer 20 exists from a surface of the steel sheet inward of the steel sheet. In FIG. 1, the oxide layer 20 exists only on one side of the steel sheet, but it is also possible that the oxide layer 20 exists on both sides.

The oxide layer 20 means from the steel sheet surface to the depth at which the oxygen peak becomes '0' in the Fe—O diagram shown as a result of GDS.

The thickness of the oxide layer 20 may be 10.0 nm or less. When the thickness of the oxide layer 20 is too thick, acid reactivity may be slowed down, which may not be appropriate. More specifically, the thickness of the oxide layer 20 may be 1 to 10.0 nm.

In the manufacturing process of the steel sheet to be described below, components such as Mn, Si, Al, and P contained in the steel sheet are diffused from the inside of the steel sheet to the surface of the steel sheet and are concentrated in the oxide layer 20.

In this case, the contents of Mn, Si, Al, and P existing in the oxide layer 20 may satisfy Formula 1 below.

$$([Mn]+[Si]+[Al])/(3\times[P])\leq 0.60 \quad \text{[Formula 1]}$$

(In formula 1, [Mn], [Si], [Al] and [P] mean the maximum amount of each element when elemental analysis is carried out in the thickness direction of the oxide layer.)

When Formula 1 exceeds 0.6, the amount of P in the oxide layer is low or the content of Mn, Si, and Al is high. When the amount of P in the oxide layer is low, the amount of P, which is an element securing acid reactivity, is reduced, and appropriate phospatability may not be obtained. In addition, when the content of Mn, Si, and Al is high, a large amount of oxides of Mn, Si, and Al are formed, so appropriate phospatability may not be obtained. Therefore, as described above, the content of Formula 1 may be 0.60 or less. More specifically, the value of Formula 1 may be 0.20 to 0.60.

The maximum amount of P in the oxide layer 20 may be 1.0 to 3.0 wt %, the maximum amount of Mn may be 0.80 to 1.5 wt %, the maximum amount of Si may be 0.50 to 1.50 wt %, and the maximum amount of Al may be 0.30 to 1.0 wt %.

The steel sheet with excellent phosphatability may contain cementite in an area fraction of 2% or more, and the balance of ferrite. It is known that a phenomenon that causes corrosion in an acid reaction is the formation of a small circuit in the electrolyte. In this case, when there is only a stable ferrite-based Fe single phase that causes a cathodic reaction, the acid reaction does not occur, and cathodic sites represented by cementite etc., may promote the reaction. However, since the potential for dissolution in an acid environment is small in the case of such a cathode, acid reactivity may rather deteriorate if it has an excessively large amount. More specifically, cementite may be contained in amount of 2.0 to 5.0 area %. Other phases may be further included at 0.5 area % or less.

In an embodiment of the present invention, the steel sheet has excellent phospatability, excellent corrosion resistance, appropriate yield strength, and excellent productivity.

In an embodiment of the present invention, the phospatability is measured through the Pickle lag (P/L) measurement method. This is a method of indirectly measuring acid reactivity by degreasing a surface of a specimen having 75×100 mm with alkali in 5 wt % of sulfuric acid aqueous solution, confirming the degreasing performance by confirming that water wettability is 100%, and then depositing the specimen to measure a degree of formation of $H_2$ gas formed by ion elution of Fe on the surface, and is a test of measuring the time required for the hydrogen gas to cover the entire area. As a result, the longer the P/L time, the greater the influence of the surface oxide, resulting in poor acid reactivity and consequently poor phosphate treatability. In an embodiment of the present invention, when the steel sheet is immersed in 5% of sulfuric acid aqueous solution at 30° C., the Pickle lag time may be 20 seconds or less. More specifically, the Pickle lag time may be 5 to 20 seconds.

When measuring the Pickle lag, the time is measured by observing the surface of the steel sheet with a camera, but there is an aspect in which hydrogen gas that is not visually visible is not measured. In an embodiment of the present invention, in addition to the Pickle lag time, the steel sheet was immersed in 5 wt % of sulfuric acid aqueous solution and reacted at 30° C., and after 5 minutes have elapsed, the item, the corrosion reduction ratio obtained by dividing an initial weight of the specimen and a final weight of the specimen by an immersion time and an immersion area was measured to quantify the phospatability. That is, the corrosion reduction ratio is an indicator of acid reactivity and is a value indicating how quickly Fe ions are eluted when the steel sheet is exposed to an acid environment of a certain concentration. In other words, the higher the corrosion reduction ratio, the easier the elution of Fe and the easier the formation of phosphate nucleus, and the higher the density of the phosphate nucleus, the easier the phosphate treatment.

In an embodiment of the present invention, when immersed at 30° C. in 5% of sulfuric acid aqueous solution, the corrosion reduction ratio may be 0.550 mg/cm$^2$/hr or more. More specifically, the corrosion reduction ratio may be 0.550 to 0.700 mg/cm$^2$/hr.

When manufacturing a product using a steel sheet in an embodiment of the present invention, formability for soundness in the manufacturing process needs to be ensured. That is, it is necessary to secure strength for pressure resistance, dent resistance, and the like in a use environment. Accordingly, in an embodiment of the present invention, the steel sheet may have a yield strength of 220 to 270 MPa. When the yield strength is too high, the formability may be a problem, and when the yield strength is too low, problems may occur in terms of the pressure resistance and the dent resistance.

As described above, the steel sheet according to an embodiment of the present invention is easy to treat with phosphate, and after the phosphate treatment, fine phosphate having an average value of major axes of phosphate particles of 10 μm or less may exist on the surface of the steel sheet, and it may cover more than 90% of the entire area of the observation plane.

Phosphate particles formed in the present invention are mainly leaf-shaped Hopeite particles. The length of the major axis of the hopeite particle is defined as the length of the longest axis when observing a single phosphate particle from the observation plane. In order to calculate the average value, after measuring 30 or more randomly calculated single phosphate particles, the average of the measured values may be calculated. The observation plane may be a plane parallel to the rolling plane (ND plane).

In this case, the phosphate treatment means that a zinc phosphate solution is applied to the steel sheet and then treated at a temperature of 30 to 40° C. for 60 to 120 seconds. More specifically, the phosphate treatment means that the steel sheet is formed and processed to suit the purpose and then oil applied to the surface through a degreasing process is removed, and after surface conditioning, zinc phosphate solution is applied by dipping or spraying, and then treated at a temperature of 30 to 40° C. for 60 to 120 seconds.

A method for manufacturing a steel sheet with excellent phospatability according to an embodiment of the present invention includes manufacturing a hot-rolled steel sheet by hot-rolling a slab; manufacturing a cold-rolled steel sheet by cold-rolling the hot-rolled steel sheet; annealing the cold-rolled steel sheet; and temper-rolling the annealed cold-rolled steel sheet.

Hereinafter, each step will be described in detail.

First, the slab is hot-rolled to manufacture the hot-rolled steel sheet.

Since the alloy composition of the slab is described in the steel sheet described above, duplicate description thereof will be omitted. Since the alloy composition is not substantially changed during the manufacturing process of the steel sheet, the alloy composition of the steel sheet and the alloy composition of the slab are substantially the same.

The slab may be heated prior to hot-rolling. The heating temperature of the slab may be 1200° C. or higher. Since most precipitates present in the steel must be re-dissolved, a temperature of 1,200° C. or higher may be required. More specifically, the heating temperature of the slab may be 1250° C. or higher.

In the manufacturing of the hot-rolled steel sheet, the final hot rolling temperature (FDT) may be 800 to 950° C. More specifically, it may be 850 to 930° C.

In the manufacturing of the hot-rolled steel sheet, a coiling temperature is 650 to 750° C. The coiling temperature affects the fraction of other phases such as cementite in addition to the ferrite single phase. The higher the coiling temperature, the higher the cementite fraction. An appropriately adjusted cementite fraction may work favorably to improve phospatability.

After the manufacturing of the hot-rolled steel sheet, the hot-rolled steel sheet is cold-rolled to manufacture the cold-rolled steel sheet. In this case, the reduction ratio may be 70 to 85%. It is advantageous for the phospatability by maximizing the surface γ-fiber texture in the above range.

Next, the cold-rolled steel sheet is annealed.

In this case, the soaking temperature may be 700 to 780° C.

As the annealing temperature is lowered, the fraction of oxides formed on the surface of the steel material is reduced, which is advantageous for the acid reactivity. However, the diffusion of P to the surface is reduced at a low annealing temperature, and since this also causes the inhibition of the acid reactivity, an appropriate lower limit temperature is required.

In the annealing step, the annealing may be performed in an atmosphere containing 5% by volume or more of hydrogen and the rest of nitrogen and at a dew point of −30° C. or lower. By managing the annealing atmosphere at a reducing and low dew point temperature, the oxides formed on the surface may be suppressed as much as possible.

Next, the annealed cold-rolled steel sheet is temper-rolled. The temperrolling may be performed at a reduction ratio of 1.0 to 3.0%. A more suitable reduction ratio varies in proportion to the thickness of the specimen but may be 1.0 to 2.0%.

After the step of annealing the cold-rolled steel sheet, before the temper-rolling of the annealed cold-rolled steel sheet, the cooling is performed to a final cooling temperature of 80 to 150° C. The final cooling temperature is advantageous as it is lower, but it may be cooled to 90° C. to 120° C. in terms of operating conditions.

Hereinafter, the present invention will be described in more detail through examples. However, these examples are only for illustrating the present invention, and the present invention is not limited thereto.

EXPERIMENTAL EXAMPLE 1

A cold-rolled steel sheet was manufactured by performing hot rolling, cold rolling, annealing, and temper rolling on a slab having compositions of Table 1 below. After the hot rolling, a coiling temperature was fixed at 700° C., a cold-rolling reduction ratio was 80%, an annealing temperature was 760° C., and a final cooling temperature after the annealing was 100° C. The temperrolling reduction ratio was adjusted to 1.5% to produce a final thickness of 1.0 mm. During the annealing heat treatment, the hydrogen concentration was controlled to 4.5% and the dew point was controlled to −40° C.

The final manufactured cold-rolled sheet was analyzed through GDS analysis, and the results are shown in Table 1. In addition, the indicator of the surface element shown in Formula 1 is also shown.

The GDS analysis was compared by measuring at a scan rate of 1000 points per second by applying a potential of 21 W at a voltage of 700V and a current of 30 mA according to a Zn Galv RF measurement method. After measuring from the surface to a depth of 0.01 μm in a thickness direction, the content of each element was calculated using a calibration factor of 0.7.

In addition, a thickness of the oxide layer analyzed through the GDS of the manufactured steel sheet, a pickle lag time which is the time it takes for hydrogen bubbles to cover the entire area of the steel sheet after immersion in 5% of sulfuric acid at 30° C., a unit surface area when immersed in the same solution for 5 min, a corrosion loss ratio indicating a corrosion loss per unit time, a yield strength of steel, and a crack formation tendency of a folding part in the case of folding by 180° were measured, which is summarized in Table 2.

The pickle lag (P/L) measured the degree of formation of $H_2$ gas formed by ion elution of Fe on the surface by degreasing a surface of a specimen having 75×100 mm with alkali in 5 wt % of sulfuric acid aqueous solution, confirming the degreasing performance by confirming that water wettability is 100%, and then depositing the specimen, and the time required for the hydrogen gas to cover the entire area was measured.

The corrosion reduction ratio was calculated by immersing the specimen in 5 wt % of sulfuric acid aqueous solution, reacting the specimen at 30° C., and after 5 minutes has elapsed, dividing an initial weight of the specimen and a final weight of the specimen by an immersion time and an immersion area.

In addition, after folding the manufactured specimen by 180° C., it was determined whether cracks occurred in the folded portion of the specimen.

A cementite fraction was measured after polishing the surface of the steel sheet which is the surface to which phosphate is applied.

A major axis of the phosphate particle was treated by applying a zinc phosphate solution and maintaining it at a temperature of 30 to 40° C. for 60 to 120 seconds, and a length of the longest axis was measured by observing a single phosphate particle formed on the surface of the steel sheet. After measuring more than 30 randomly calculated single phosphate particles, the average of the measured values was calculated.

TABLE 1

| | C | Mn | Si | Al | P | P Maximum amount | Mn Maximum amount | Si Maximum amount | Al Maximum amount | (Mn + Si + Al)/3 × P |
|---|---|---|---|---|---|---|---|---|---|---|
| Example 1 | 0.04 | 0.11 | 0.005 | 0.018 | 0.02 | 1.64 | 0.65 | 0.87 | 0.46 | 0.40 |
| Example 2 | 0.04 | 0.24 | 0.005 | 0.018 | 0.02 | 1.55 | 1.15 | 1.23 | 0.38 | 0.59 |
| Example 3 | 0.04 | 0.15 | 0.005 | 0.019 | 0.02 | 1.60 | 0.95 | 0.78 | 0.51 | 0.47 |
| Example 4 | 0.04 | 0.15 | 0.005 | 0.018 | 0.016 | 1.23 | 0.86 | 0.89 | 0.38 | 0.58 |
| Example 5 | 0.04 | 0.15 | 0.005 | 0.018 | 0.038 | 2.64 | 0.86 | 0.96 | 0.43 | 0.28 |
| Example 6 | 0.04 | 0.15 | 0.009 | 0.018 | 0.02 | 1.53 | 0.87 | 1.36 | 0.39 | 0.57 |
| Example 7 | 0.025 | 0.15 | 0.005 | 0.018 | 0.02 | 1.43 | 0.95 | 1.14 | 0.46 | 0.59 |
| Example 8 | 0.055 | 0.15 | 0.005 | 0.018 | 0.02 | 1.50 | 0.88 | 1.28 | 0.48 | 0.59 |
| Comparative Example 1 | 0.04 | 0.07 | 0.005 | 0.018 | 0.02 | 1.60 | 0.25 | 1.28 | 0.51 | 0.43 |
| Comparative Example 2 | 0.04 | 0.25 | 0.005 | 0.018 | 0.02 | 1.55 | 1.56 | 1.48 | 0.43 | 0.75 |
| Comparative Example 3 | 0.04 | 0.15 | 0.005 | 0.023 | 0.02 | 1.50 | 0.99 | 0.89 | 0.85 | 0.61 |
| Comparative Example 4 | 0.04 | 0.15 | 0.005 | 0.018 | 0.013 | 0.98 | 0.79 | 0.85 | 0.46 | 0.71 |
| Comparative Example 5 | 0.04 | 0.15 | 0.005 | 0.018 | 0.043 | 3.40 | 0.83 | 0.68 | 0.43 | 0.19 |
| Comparative Example 6 | 0.04 | 0.15 | 0.015 | 0.018 | 0.02 | 1.58 | 0.81 | 2.45 | 0.41 | 0.77 |
| Comparative Example 7 | 0.015 | 0.15 | 0.005 | 0.018 | 0.02 | 1.60 | 0.89 | 0.59 | 0.4 | 0.39 |
| Comparative Example 8 | 0.065 | 0.15 | 0.005 | 0.018 | 0.02 | 1.48 | 0.82 | 0.87 | 0.39 | 0.47 |

TABLE 2

| | Cementite fraction (%) | Thickness of oxide layer (nm) | Pickle lag time (sec.) | Corrosion reduction ratio (mg/cm$^2$/hr.) | Yield strength (MPa) | 180° folding crack tendency | Length of major axis of phosphate particle (μm) |
|---|---|---|---|---|---|---|---|
| Inventive Example 1 | 3.25 | 7.8 | 13 | 0.685 | 222 | X | 5.34 |
| Inventive Example 2 | 3.22 | 9.3 | 19 | 0.573 | 248 | X | 8.23 |

TABLE 2-continued

| | Cementite fraction (%) | Thickness of oxide layer (nm) | Pickle lag time (sec.) | Corrosion reduction ratio (mg/cm$^2$/hr.) | Yield strength (MPa) | 180° folding crack tendency | Length of major axis of phosphate particle (μm) |
|---|---|---|---|---|---|---|---|
| Inventive Example 3 | 3.24 | 8.9 | 16 | 0.639 | 242 | X | 6.25 |
| Inventive Example 4 | 3.25 | 9.5 | 20 | 0.565 | 232 | X | 9.80 |
| Inventive Example 5 | 3.24 | 7.5 | 11 | 0.735 | 265 | X | 3.28 |
| Inventive Example 6 | 3.15 | 9.8 | 17 | 0.628 | 234 | X | 8.45 |
| Inventive Example 7 | 2.18 | 9.5 | 18 | 0.593 | 221 | X | 9.23 |
| Inventive Example 8 | 4.25 | 9.1 | 15 | 0.635 | 269 | X | 6.34 |
| Comparative Example 1 | 3.25 | 7.7 | 12 | 0.674 | 212 | X | 5.68 |
| Comparative Example 2 | 3.21 | 11.2 | 22 | 0.528 | 252 | X | 15.85 |
| Comparative Example 3 | 3.14 | 10.8 | 21 | 0.529 | 248 | X | 13.45 |
| Comparative Example 4 | 3.05 | 13.5 | 32 | 0.475 | 222 | X | 17.46 |
| Comparative Example 5 | 3.15 | 7.3 | 9 | 0.706 | 274 | ○ | 4.85 |
| Comparative Example 6 | 3.14 | 10.5 | 22 | 0.515 | 237 | X | 16.84 |
| Comparative Example 7 | 1.85 | 11.8 | 24 | 0.498 | 207 | X | 15.23 |
| Comparative Example 8 | 4.85 | 9.6 | 23 | 0.538 | 272 | ○ | 14.28 |

In Comparative Examples 2, 3, and 6, Mn, Al, and Si in the steel sheet were added in excess, so Formula 1 was not satisfied and the oxide layer was thick. As a result, the pickle lag time increases and the corrosion reduction ratio decreases. That is, the phospatability is poor.

Too low P is added, and thus, Comparative Example 4 did not satisfy Formula 1. Since P, which promotes acid reactivity, is not appropriately contained, the pickle lag time becomes longer and the corrosion reduction ratio becomes smaller. That is, the phospatability is poor.

Comparative Examples 7 and 8 correspond to the case where too high or too low C is added, and cementite is not properly formed, so the pickle lag time increases and the corrosion reduction ratio also decreases. That is, the phospatability is poor. In addition, it can be confirmed that cracks occur when the yield strength is insufficient or the yield strength is too high.

In the case of Comparative Example 1, there was a problem that the strength was insufficient by managing the content of Mn having a solid solution strengthening effect to be low.

In Comparative Example 5, it can be confirmed that the yield strength is increased because the P content is too high, and cracks occur.

Figure 2:
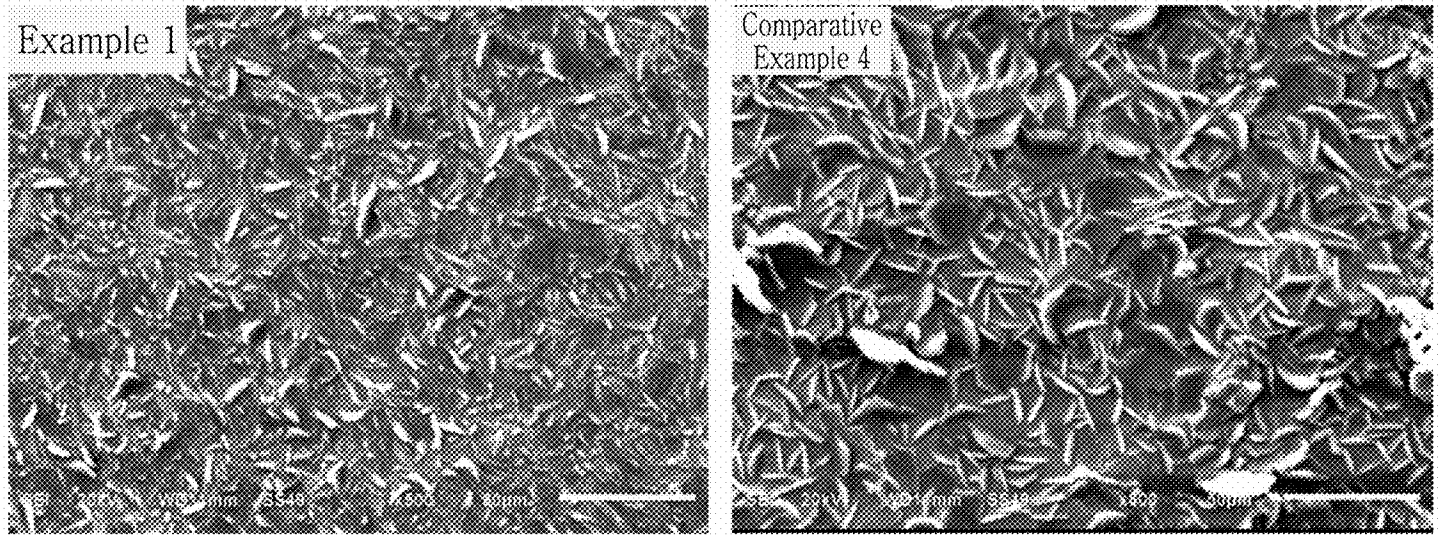
FIG. 2 is a photograph of an outer surface of steel sheets manufactured in Example 1 and Comparative Example 4 after phosphate treatment with a scanning electron microscope (SEM).

FIG. 2 is a photograph of an outer surface of steel sheets manufactured in Example 1 and Comparative Example 4 after phosphate treatment with a scanning electron microscope (SEM).

It can be seen that Example 1, which has a short pickle lag time and a large corrosion reduction ratio, has a finer size of phosphate particles and is more evenly distributed over the entire surface (near 100%) of the steel sheets compared to Comparative Example 4.

Figure 3:
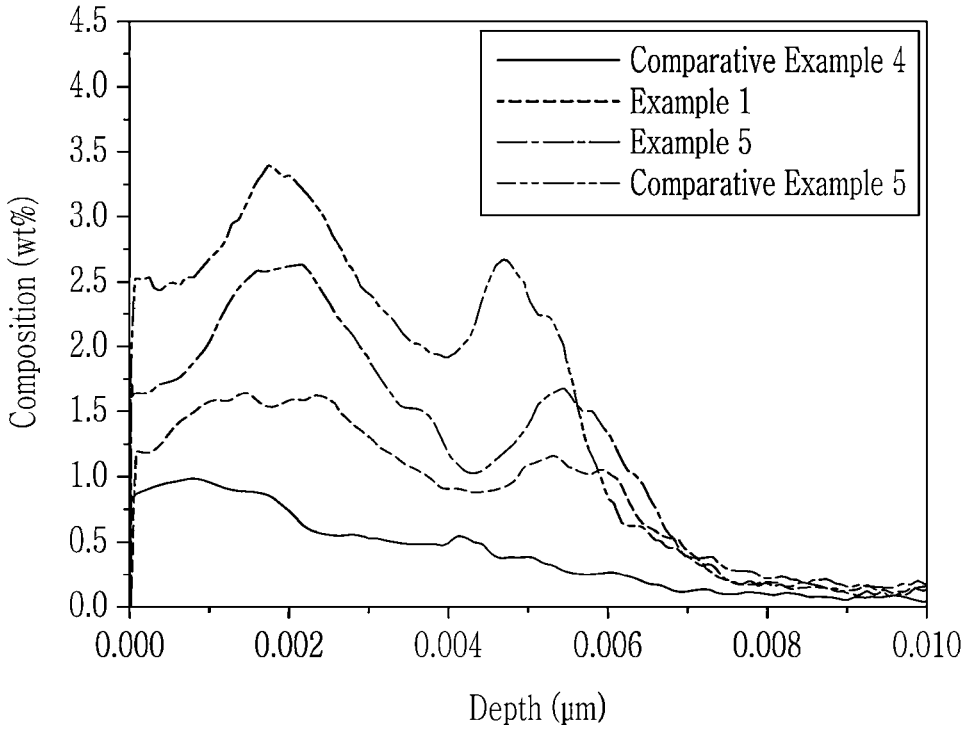
FIG. 3 is a graph of glow dispersion spectroscopy (GDS) analysis of P content of the steel sheets manufactured in Example 1, Example 5, Comparative Example 4 and Comparative Example 5.

FIG. 3 is a result of glow dispersion spectroscopy (GDS) analysis of P content of the steel sheets manufactured in Example 1, Example 5, Comparative Example 4 and Comparative Example 5.

As illustrated in FIG. 3, it can be confirmed that the P content in the oxide layer also increases as the P content increases.

EXPERIMENTAL EXAMPLE 2

A cold-rolled steel sheet was manufactured by performing hot rolling, coldrolling, annealing, and temperrolling on a slab having the compositions of Example 1 at a reduction rate of 1.5%. However, the conditions in each process were adjusted as shown in Table 3 below.

TABLE 3

| | Coiling temperature (° C.) | Annealing temperature (° C.) | Cementite fraction (%) | Thickness of oxide layer (nm) | (Mn + Si + Al)/3 × P | Length of major axis of phosphate particle (μm) | Pickle lag time (sec,) | Corrosion reduction ratio (mg/cm$^2$/hr.) |
|---|---|---|---|---|---|---|---|---|
| Example 1 | 700 | 760 | 3.25 | 7.8 | 0.40 | 5.34 | 13 | 0.685 |
| Example 9 | 660 | 760 | 3.01 | 7.7 | 0.37 | 9.85 | 16.6 | 0.55 |

TABLE 3-continued

| | Coiling temperature (° C.) | Annealing temperature (° C.) | Cementite fraction (%) | Thickness of oxide layer (nm) | (Mn + Si + Al)/ 3 × P | Length of major axis of phosphate particle (μm) | Pickle lag time (sec,) | Corrosion reduction ratio (mg/cm$^2$/hr.) |
|---|---|---|---|---|---|---|---|---|
| Example 10 | 740 | 760 | 3.86 | 7.8 | 0.48 | 7.84 | 18.06 | 0.625 |
| Example 11 | 700 | 700 | 3.23 | 6.6 | 0.33 | 4.58 | 10.8 | 0.715 |
| Example 12 | 700 | 780 | 3.24 | 9 | 0.51 | 9.25 | 18.8 | 0.58 |
| Comparative Example 9 | 630 | 760 | 1.68 | 7.8 | 0.36 | 15.85 | 22.5 | 0.528 |
| Comparative Example 10 | 760 | 760 | 4.35 | 7.8 | 0.61 | 13.55 | 21.5 | 0.546 |
| Comparative Example 11 | 700 | 650 | 3.23 | 7.8 | 0.66 | 14.25 | 22 | 0.538 |
| Comparative Example 12 | 700 | 800 | 3.23 | 10.9 | 0.67 | 18.58 | 25.3 | 0.473 |

As shown in Table 3, it was found that the manufacturing conditions of the steel sheet affect the phospatability.

As shown in Comparative Examples 9 and 10, the higher the coiling temperature, the higher the fraction of cementite. The phenomenon that the reactivity decreases due to the problem that, as in Comparative Example 9, when the fraction is low, the acid reactivity is inhibited, and as in Comparative Example even when the fraction is too high, the reaction area of the cementite phase with low acid reactivity is widened can be confirmed.

Comparative Examples 11 and 12 show the degree of influence of the annealing temperature. The lower the annealing temperature, the lower the fraction of oxides formed on the surface of the steel material, which is advantageous for acid reactivity. However, in the present invention, the content of P showing the effect decreases on the surface at a low annealing temperature, and there is an adverse effect of causing the inhibition of the acid reactivity. That is, when the annealing temperature is too high or low, it can be confirmed that the value of Formula 1 is not satisfied and the acid reactivity is lowered.

The present invention is not limited to the embodiments, but may be manufactured in a variety of different forms, and those of ordinary skill in the art to which the present invention pertains will understand that the present invention may be implemented in other specific forms without changing the technical spirit or essential features of the present invention. Therefore, it should be understood that the above-mentioned embodiments are exemplary in all aspects but are not limited thereto.

| [Description of Reference Signs] | |
|---|---|
| 10: Steel sheet, | 20: Oxide layer |

The invention claimed is:

1. A steel sheet with excellent phosphatability, comprising:

by wt %, 0.02 to 0.06% of carbon (C), 0.01% or less of silicon (Si) (excluding 0%), 0.1 to 0.24% of manganese (Mn), 0.02% or less of aluminum (Al) (excluding 0%), 0.015 to 0.04% of phosphorus (P), and the balance of iron (Fe) and inevitable impurities, wherein the steel sheet has an oxide layer having a thickness of 10 nm or less inward from the surface of the steel sheet, satisfying the following formula 1, and contains cementite in an area fraction of 2% or more, and the balance of ferrite, $$([Mn]+[Si]+[Al])/(3\times[P])\leq 0.60 \quad \text{[Formula 1]}$$

wherein, in formula 1, [Mn], [Si], [Al] and [P] mean the maximum amount of each element when elemental analysis is carried out in the thickness direction of the oxide layer.

2. The steel sheet of claim 1, wherein:

a pickle lag time is 20 seconds or less when the steel sheet is immersed in 5% concentration of sulfuric acid aqueous solution at 30° C.

3. The steel sheet of claim 1, wherein:

when the steel sheet is immersed in 5% concentration of sulfuric acid aqueous solution at 30° C., a corrosion reduction ratio is 0.55 mg/cm$^2$/hr or more.

4. The steel sheet of claim 1, wherein:

yield strength is 220 to 270 MPa.

5. The steel sheet of claim 1, wherein:

an average length of major axes of phosphate particles formed after phosphate treatment is 10 μm or less.

6. The steel sheet of claim 1, wherein:

phosphate particles formed after phosphate treatment occupy 90 area % or more of the surface of the steel sheet.

7. A method of manufacturing the steel sheet with excellent phosphatability according to claim 1, comprising:

manufacturing a hot-rolled steel sheet by hot-rolling a slab containing, by wt %, 0.02 to 0.06% of carbon (C), 0.01% or less of silicon (Si) (excluding 0%), 0.1 to 0.24% of manganese (Mn), 0.02% or less of aluminum (Al) (excluding 0%), 0.015 to 0.04% of phosphorus (P), and the balance of iron (Fe) and inevitable impurities;

manufacturing a cold-rolled steel sheet by cold-rolling the hot-rolled steel sheet;

annealing the cold-rolled steel sheet; and temper-rolling the annealed cold-rolled steel sheet, wherein, in the manufacturing of the hot-rolled steel sheet, a coiling temperature is 650 to 750° C., and in the annealing step, a soaking temperature is 700 to 780° C.

8. The method of claim 7, wherein:

in the manufacturing of the hot-rolled steel sheet, the final hot rolling temperature (FDT) is 800 to 950° C.

9. The method of claim 7, wherein:

in the manufacturing of the cold-rolled steel sheet by the cold-rolling, the reduction ratio is 70 to 85%.

10. The method of claim 7, wherein:

after the step of annealing the cold-rolled steel sheet and before the temper rolling of the annealed cold-rolled steel sheet, the cooling is performed to the final cooling temperature of 80 to 150° C.

11. The method of claim 7, wherein:

in the annealing step, the annealing is performed in an atmosphere containing 5% by volume or more of hydrogen and the rest of nitrogen and at a dew point of −30° C. or lower.

* * * * *